United States Patent [19]

Balleis

[11] Patent Number: 4,695,263

[45] Date of Patent: Sep. 22, 1987

[54] TOY SPINNING TOP HAVING A LEG SUPPORT

[75] Inventor: Peter Balleis, Zirndorf, Fed. Rep. of Germany

[73] Assignee: Lorenz Bolz GmbH & Co., Zirndorf, Fed. Rep. of Germany

[21] Appl. No.: 887,104

[22] PCT Filed: Sep. 24, 1985

[86] PCT No.: PCT/DE85/00330

§ 371 Date: Jun. 12, 1986

§ 102(e) Date: Jun. 12, 1986

[87] PCT Pub. No.: WO86/02280

PCT Pub. Date: Apr. 24, 1986

[30] Foreign Application Priority Data

Oct. 12, 1984 [DE] Fed. Rep. of Germany ... 8430096[U]

[51] Int. Cl.[4] ..... A63H 27/00

[52] U.S. Cl. ..... 446/256; 446/264

[58] Field of Search ..... 446/256, 264

[56] References Cited

U.S. PATENT DOCUMENTS

| | | | |
|---|---|---|---|
| 1,262,061 | 4/1918 | Kristofer | 446/256 |
| 1,267,558 | 5/1918 | Komorous | 446/256 |
| 2,394,093 | 2/1946 | Nalle, Jr. | 446/256 |
| 2,639,921 | 5/1953 | Saunders | 446/256 X |
| 3,083,498 | 4/1963 | Kelley | 446/256 X |

*Primary Examiner*—Philip C. Kannan

*Attorney, Agent, or Firm*—Spencer & Frank

[57] ABSTRACT

A top with a preferably tapered support foot (1), which has an opening (7) to receive the axle of the top (6) and is firmly connected with a spring ring (5) to the axle of the top (6), whereby the spring ring (5) has a hat-shaped cover (9). A protection against withdrawal in any direction is provided by the fact that the spring ring (5) is cast or injection-moulded as part of the support foot.

3 Claims, 2 Drawing Figures

TOY SPINNING TOP HAVING A LEG SUPPORT

Figure 2:
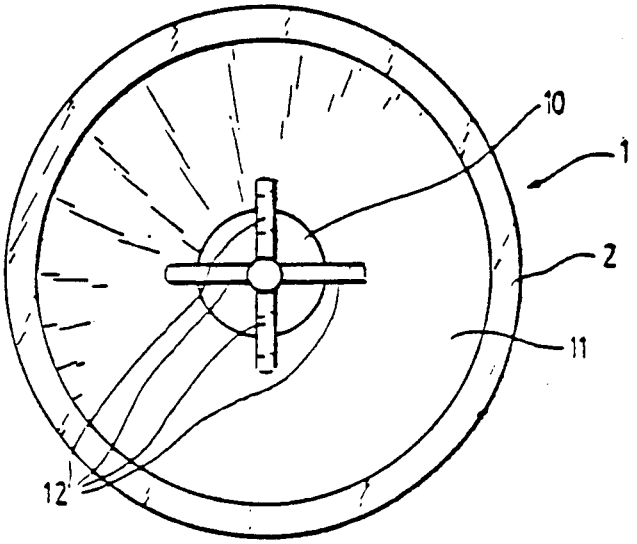

The invention relates to a toy spinning top of the type defined in detail in the preamble of claim 1.

Prior art toy spinning tops are known in which the lower end of their shaft is simply inserted into a corresponding recess in the generally cone shell shaped support base for the top. The resulting friction lock connection serves to more or less securely fasten these two parts together.

Pursuant to new safety regulations, the support base must be connected with the top shaft in a manner secure against removal so as to reduce the danger of injury in handling such a toy. For this purpose, the recess in the cone shell is extended into a passage opening through which the outer end of the top shaft is pushed. From the underside of the support base, a spring ring is pushed onto the end of the shaft. To make the top safe against removal not only in the direction of the cone tip but also in the direction of the ccone base, a radially outwardly extending projection—for example a pinched-on portion—is provided at the shaft of the top. To make this radial projection effective over the entire circumference of the shaft, a washer is disposed between the plastic base and the pinched-on portion. On its side facing the placement surface of the top, the spring ring is provided with a hat-like covering hood which protects the push-through end of the top shaft against manipulation..

The drawback of this manner of fastening is that the fastening elements are still openly accessible at the exterior of the base. Thus it is possible, for example, to wiggle off the spring ring and remove the base. Moreover, a danger of injury may still exist from the fastening members which project radially beyond the shaft outside the base.

It is the object of the invention to make the fastening of the top shaft in the base even more secure against removal and to exclude any danger of injury.

This is accomplished according to the characterizing feature of claim 1. By encasing the spring ring on all sides with the plastic material of the base, the spring ring is secured against displacement with respect to the base in both axial directions. In connection with the encasing of the spring ring in the plastic material of the base, the presence of the covering hood of the spring ring out to be a significant production aid. Together with the spring ring, the covering hood forms a cavity which during injection molding of the base remains essentially free of plastic material. Thus the later insertion of the top shaft into the spring ring is facilitated. It is assured that the end of the top shaft is pushed through to the abutment in the interior of the hat-like covering hood. The top shaft thus safely and accurately reaches its intended position with respect to the spring ring. Molding the upper side of the spring ring to the plastic material of the base results in a firmly adhering connection between the spring ring and the plastic material which is known to have a certain inherent elasticity. Since molding the spring ring takes place when the ring is in its relaxed starting position, this adhesive connection generates a resetting force which additionally acts on the spring ring and increases the clamping pressure exerted on the top shaft by the spring ring. The relatively large area of the covering hood provides an excellent protection against the top shaft piercing the base. During assembly, the top shaft is inserted into the base and thus into the spring ring from the top through the preferably rotationally axially disposed recess that has been produced during the injection molding process. The spring ring, together with the hat-shaped cover, acts as protection against displacement of the base with respect to the axis of rotation of the top, a protection which is effective on both sides.

The base fastening structure according to the invention thus includes no externally disposed fastening elements. Thus, any danger of injury is avoided right from the start. Additionally, the fastening elements thus lie outside of the range of any possible manipulations; for example, curious children can no longer remove the spring ring and pull off the base. A durable, secure connection is thus assured between the base and the top shaft.

This manner of construction also considerably simplifies assembly of the toy top since the top shaft need only be inserted until it abuts into the recess provided for this purpose. Pinching the top shaft and the addition of a washer are no longer necessary.

Particularly advantageous embodiments of the base for a toy top are defined by the characterizing features of claims 2 and 3. The reinforcing ribs in the interior of the cone shell make the base itself more stable and the region where the spring ring is embedded is better supported with respect to the cone shell region.

Figure 1:
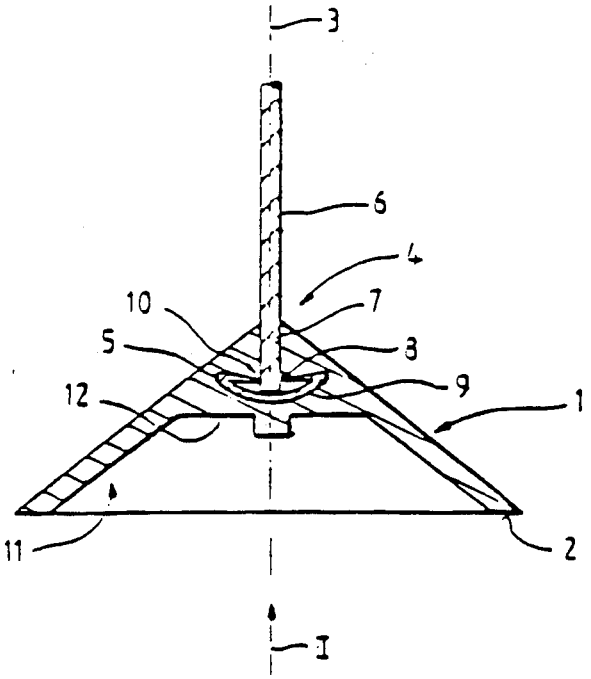

One embodiment of the invention will now be described in greater detail with reference to the drawing figures. It is shown in:

FIG. 1, a longitudinal sectional view through the base of a toy spinning top according to the invention along its rotation axis;

FIG. 2, a view of the base from direction II of FIG. 1.

The base 1 has essentially the shape of a cone shell and the circumference of its cone base 2 rests on the floor at a relatively large distance from the rotation axis 3. In the region of the cone tip 4, there is the spring ring 5 which is surrounded on all sides by the material of the base. To accommodate top shaft 6, a rotationally axially disposed aperture 7 is provided in cone tip 4 and opens into the passage opening 8 for spring ring 5. The free space of top shaft 6 in the insertion direction is delimited by a covering hood 9 for metal spring ring 5. The embedment region 10 in cone tip 4 of base 1 is supported, in the interior 11 of the cone shell, by the radially extending reinforcing ribs 12 which project perpendicularly downwardly from the plane of the embedment region.

I claim:

1. Toy spinning top comprising a top body which rotates about a stationary to shaft (6); and a base (1) made of an injection moldable or castable plastic for holding the top shaft (6) in a substantially vertical orientation, with the top shaft (6)

being supported in a vertical aperture (7) of the base (1); and being secured against removal from the base (1) by a spring ring (5) placed onto its lower end; and the spring ring (5) is provided, at the side facing the floor when the top is stood up, with a covering hood (9) which extends over the plane of the spring ring (5) and covers the lower end of the top shaft (6) in the manner of a hat, characterized in that the spring ring (5) and its covering hood (9) are embedded in the plastic material of the base (1).

2. Toy spinning top according to claim 1, characterized in that the base (1) has the shape of a cone shell with the tip (4) of the cone being oriented upwardly and the spring ring (5) is cast or injection molded into the material forming the cone tip (4) of the base (1).

3. Toy spinning top according to claim 2, characterized in that the region of the base which encloses the covering hood (9) of the spring ring (5) in the interior (11) of the cone shell is provided with radially extending reinforcing ribs (12) which project vertically downwardly from the plane of the embedment region (10).

* * * * *